US007160001B2

(12) United States Patent
Bartlett

(10) Patent No.: US 7,160,001 B2
(45) Date of Patent: Jan. 9, 2007

(54) FOCUS ASSEMBLY FOR A TRACK LIGHT

(75) Inventor: Paul Bartlett, Newnan, GA (US)

(73) Assignee: Cooper Industries, Houston, TX (US)

( * ) Notice: Subject to any disclaimer, the term of this patent is extended or adjusted under 35 U.S.C. 154(b) by 47 days.

(21) Appl. No.: 10/685,033

(22) Filed: Oct. 14, 2003

(65) Prior Publication Data

US 2005/0078482 A1 Apr. 14, 2005

(51) Int. Cl.
*F21V 19/02* (2006.01)

(52) U.S. Cl. ..... 362/285; 362/188; 362/508

(58) Field of Classification Search ..... 362/187, 362/188, 285, 277, 280, 281, 282, 202, 306, 362/319, 372, 508, 286–289
See application file for complete search history.

(56) References Cited

U.S. PATENT DOCUMENTS

| | | | | | |
|---|---|---|---|---|---|
| 999,860 | A | * | 8/1911 | Perry et al. | 362/289 |
| 1,083,530 | A | * | 1/1914 | Gallay | 362/288 |
| 1,115,033 | A | * | 10/1914 | Stearns | 362/288 |
| 1,244,880 | A | * | 10/1917 | Matteoli | 362/288 |
| 1,414,567 | A | * | 5/1922 | Godley | 362/288 |
| 1,610,127 | A | | 12/1926 | Godley | |
| 2,078,028 | A | | 4/1937 | Schneider | |
| 2,239,928 | A | * | 4/1941 | Nixon | 362/188 |
| 2,802,094 | A | * | 8/1957 | Grosz | 362/35 |
| 3,280,320 | A | * | 10/1966 | Beaton et al. | 362/288 |
| 3,858,038 | A | * | 12/1974 | Buzalski | 362/10 |
| 4,307,439 | A | | 12/1981 | Sassmannshausen | 362/186 |
| 4,533,984 | A | * | 8/1985 | Gatton | 362/232 |
| 4,967,325 | A | * | 10/1990 | Shiau | 362/188 |
| 5,017,327 | A | * | 5/1991 | Bamber | 362/289 |
| 5,086,379 | A | * | 2/1992 | Denison et al. | 362/145 |
| 5,249,109 | A | | 9/1993 | Denison et al. | 362/285 |
| 5,461,552 | A | | 10/1995 | Tillery | 362/188 |
| 5,735,594 | A | * | 4/1998 | Own | 362/202 |
| 5,938,317 | A | | 8/1999 | Thornton | 362/290 |
| 6,045,236 | A | | 4/2000 | Cheng et al. | 362/188 |
| 6,174,071 | B1 | | 1/2001 | Chan | 362/187 |
| 6,290,373 | B1 | | 9/2001 | Dwight et al. | 362/285 |
| 6,390,649 | B1 | | 5/2002 | Tang | 362/285 |
| 6,741,033 | B1 | * | 5/2004 | Scott et al. | 313/623 |
| 2003/0172750 | A1 | * | 9/2003 | Blakesley et al. | 73/862.393 |
| 2003/0231492 | A1 | * | 12/2003 | Shiau | 362/202 |

OTHER PUBLICATIONS

Cooper Lighting's Powertrac Crosshair lampholder, Model L2792 Specification.
Concord Torus 35/70 FX, dated Oct. 14, 2003, 1 page.
Concord Torus 100 FX, dated Oct. 14, 2003, 1 page.
Article, Amerlux Lighting Solutions Introduces Impact T4 Line of Compact Low Wattage Ceramic Metal Halide Lighting, 2 pages.
Pamphlet, "Introducing Impact T4, The Next Generation Of High-Performance, Energy-Efficient Display Lighting." 2 pages.

* cited by examiner

*Primary Examiner*—Renee Luebke
*Assistant Examiner*—Gunyoung T. Lee
(74) *Attorney, Agent, or Firm*—Haynes and Boone LLP; Todd Mattingly

(57) ABSTRACT

A focus assembly for a luminaire includes a socket, having wires extending therefrom, for receiving a lamp; a mounting cup for securing the socket to the luminaire; a socket focusing mechanism for axially translating the mounting cup relative to a stationary reflector; and a wire guide tab, extending from the mounting cup, for shielding the wires from the socket focus mechanism during translation of the mounting cup.

32 Claims, 15 Drawing Sheets

FOCUS ASSEMBLY FOR A TRACK LIGHT

TECHNICAL FIELD

The subject matter disclosed here generally relates to illumination, and, more particularly, to screw-actuated, adjustable light source supports for track lights.

CROSS-REFERENCE TO RELATED APPLICATIONS

The subject matter disclosed here generally relates to the subject matter of co-pending U.S. Design Patent Application Ser. No. 29/191,784 entitled "Track Luminaire and Components Therefor" filed concurrently with the present application and incorporated by reference here.

BACKGROUND

The "INESA Lighting Handbook," ninth edition, is published by the Illuminating Engineering Society of North America and is incorporated by reference here in its entirety. As discussed in chapter seven of that book, a "luminaire" is a device for producing, controlling, and distributing light. It is typically a complete lighting unit consisting of one or more lamps, sockets for positioning and protecting the lamps and for connecting the lamps to a supply of electric power, optical devices for distributing the light, and mechanical components for supporting or attaching the luminaire. Luminaires are also sometimes referred to as "light fixtures."

"Track lighting" is a term that generally refers to a system that includes at least one such luminaire and a track or rail that is designed to support the luminaire and deliver electric power. For example, the track may be mounted at or near the ceiling surface, recessed into the ceiling, or mounted horizontally or vertically along a wall. So-called track luminaires, or "track lights," come in many shapes and styles for use with a wide variety of lamps including incandescent, halogen, metal-halide, and fluorescent.

Optical control of track lighting is typically accomplished by positioning the track lights along the track and then aiming the positioned lights at a particular target area. However, other optical control techniques for track lights may utilize reflectors, refractors, diffusers, shades, hoods, cowls, and other devices. "Photometric performance" is a term that broadly refers to the efficiency and effectiveness with which a luminaire delivers light to an intended target and is often described in terms of various light distribution characteristics of a luminare. For example, a "luminous intensity distribution curve" may be used to represent the variation of luminous intensity in a plane through the light center of the luminaire. The term "beam spread" is also used to refer to the angle between two directions in a plane in which the intensity is equal to a certain percentage of the maximum beam intensity. When that intensity is 50% of the maximum intensity through the nominal beam centerline, then the term "beam angle" is also used.

Various mechanisms have been suggested for controlling beam spread and other photometric performance characteristics of track lights and other luminaires. "Marks' Standard Handbook for Mechanical Engineers," eighth edition, is also incorporated by reference here in its entirety and defines "mechanism" as that part of a machine which contains two or more pieces so arranged that the motion of one compels the motion of the other. According to Marks' Handbook, mechanisms include, but are not limited to linkages, cams, hoists, and/or elliptical trains. A "cam" is usually a plate or cylinder which communicates motion to a follower by means of its edge or a groove cut in its surface. However, other types of cam mechanisms are also known.

For flashlights, beam spread is typically controlled by providing a "focused beam." This is often accomplished by using a reflector having a generally parabolic configuration and positioning the bulb, or other light source, at or near the focal point of the reflector. Adjustable focussed beams have also been provided using a head which is secured to the flashlight body by means of inter-engaging threads, so that rotation will advance or retract the head in a longitudinal direction relative to the flashlight body. The reflector is then secured to the head while the bulb or light source is fixed to the flashlight body. By moving the head, the bulb can therefore be moved either forward or backward relative to the focal point of the reflector, so as to adjust the focus of the beam.

For example, U.S. Pat. No. 6,045,236 to Cheng et al. is incorporated by reference here and discloses an adjustable focus switch for a flashlight. The bulb holder of the Cheng et al. flashlight includes a base having helical cam slots for engaging mating pins that extend inwardly from a turning ring. As the ring is rotated, the pins move laterally along the helical cam slots. Since the position of the pins is fixed, the base moves axially to accommodate rotation of the pins. The bulb, which is coupled to the base by a retainer ring, thereby moves axially relative to a stationary reflector. A bulb spring maintains contact between the bulb and a battery casing.

U.S. Pat. No. 5,735,594 to Own is also incorporated by reference here and discloses a flashlight including a telescopic assembly for positioning a shade. Spiral grooves in the outer wall of the housing slideably engage bosses that project from the shade. Rotating the shade causes it to move axially until the bulb is withdrawn from the reflective mask so that the flashlight can be used as a traffic signal baton.

In contrast to flashlights, track luminaires often have wires extending from the lamp socket. Rotation and/or translation of these sockets can cause loosening of the wires from the socket terminals, or other damage, that creates electrical shock, and other, hazards.

SUMMARY

Various drawbacks of these and other conventional technologies are addressed here by providing a focus assembly for a luminaire and a focusable track lighting system.

In one embodiment, the focus assembly includes a socket, having wires extending therefrom, for receiving a lamp; a mounting cup for securing the socket; a socket focusing mechanism for axially translating the mounting cup relative to a stationary reflector; and a wire guide tab, extending from the mounting cup, for shielding the wires from the socket focus mechanism during translation of the mounting cup. The focus assembly may also include a wire guide wall, arranged at least partially in the mounting cup, for anchoring the wires to the mounting cup.

The focusing mechanism may include a mounting cup receptacle; a cam arranged on one of the mounting cup and the mounting cup receptacle; and a cam follower, arranged on the other of the mounting cup and the mounting cup receptacle, for engaging the cam. For example, the cam may include a helical slot arranged in a side wall of one of the mounting cups and the mounting cup receptacle, and the helical slot may include at least one notch for releaseably locking the cam follower in the slot. A spring for urging the cam follower into the notch may also be provided.

In another embodiment, the focus assembly for a luminaire includes a socket, having wires extending therefrom, for receiving a lamp; a mounting cup for securing the socket; a focusing mechanism for axially translating the mounting cup relative to a stationary reflector; and a wire guide wall, arranged at least partially in the mounting cup, for anchoring the wires to the mounting cup.

In yet another embodiment, the focus assembly for a luminaire, includes means, with wires extending therefrom, for receiving a lamp; means for securing the receiving means to the luminaire; means for axially translating the securing means to a stationary reflector; and means, extending from the securing means, for shielding the wires from the axial translating means during translation of the securing means. The focus assembly may also include means, arranged at least partially in the securing means, for anchoring the wires to the mounting cup.

The means for axially translating the securing means may include a mounting cup receptacle; a cam arranged on one of the means for securing and the mounting cup receptacle; and means for engaging the cam, arranged on the other of the means for securing and the mounting cup receptacle. For example, the cam may include a helical slot arranged in a side wall of one of the means for securing and the mounting cup receptacle. The means for engaging the cam may include a helical protuberance extending from a side wall of the other of the means for securing and the mounting cup receptacle. The helical slot may include means for releaseably locking the means for engaging in the slot. The focus assembly may also include means for urging the means for engaging into the means for releaseably locking.

In still another embodiment, a focusable track lighting system is provided with a track and a luminaire for connecting to the track, where the luminaire includes a lamp; a socket for receiving one end of the lamp; a reflector having a hole for receiving another end of the lamp; a focusing mechanism for axially translating the lamp and socket relative to the reflector; and a helical spring extending between the reflector and the socket; the helical spring having at least a portion with a closed pitch for blocking light from the lamp. For example, the lamp may be a ceramic metal halide lamp and the reflector may be nonspecular.

BRIEF DESCRIPTION OF THE DRAWINGS

These and other aspects of this technology will now be described with reference to the drawings. Various features in each figure have been drawn to scale relative to other features in the same figure. Like reference numerals have also been used to designate corresponding parts throughout each of the several views.

DETAILED DESCRIPTION OF THE ILLUSTRATED EMBODIMENTS

Figure 1:
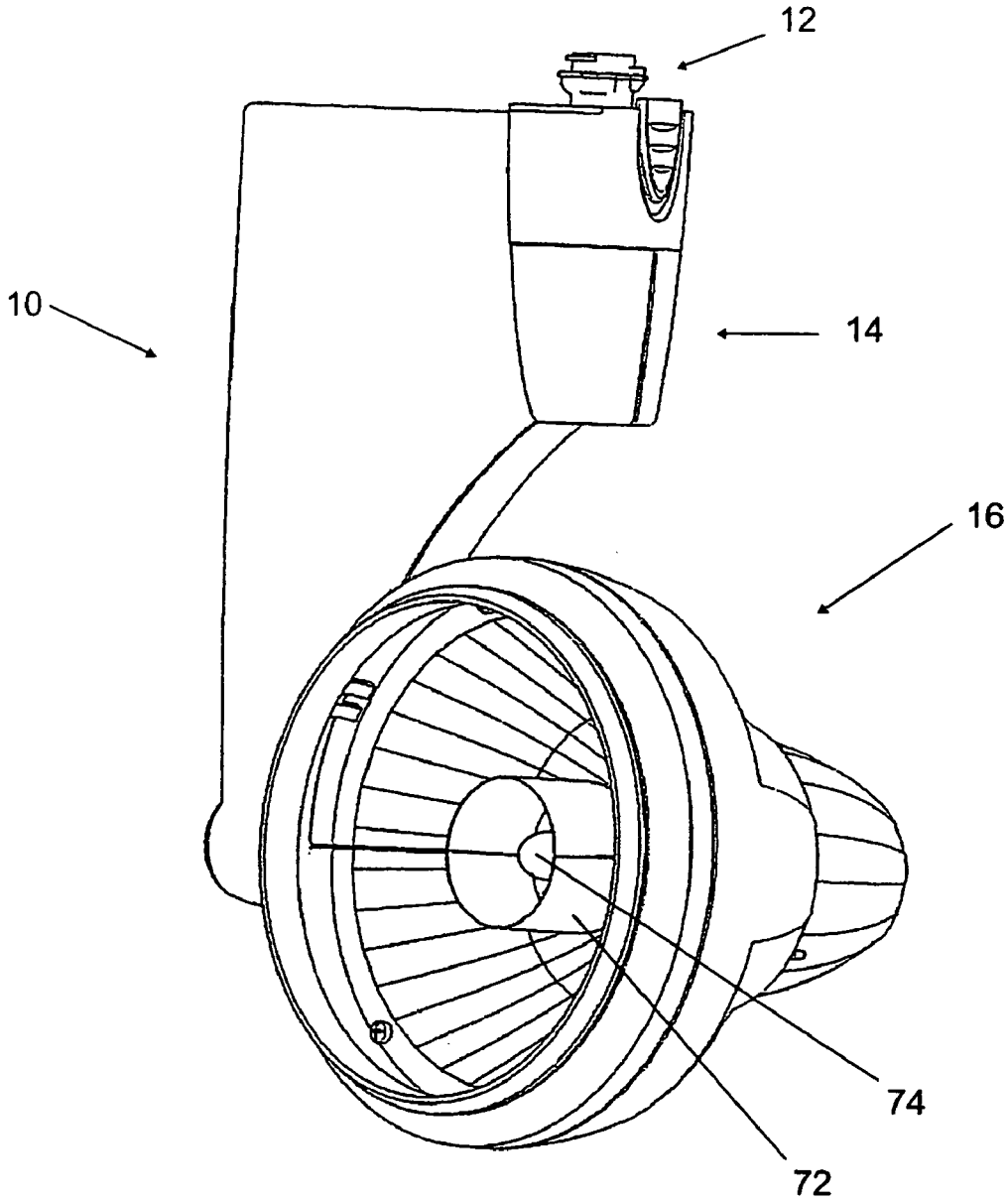
FIG. 1 is an oblique view of one embodiment of a luminaire for a track lighting system.
Figure 2:
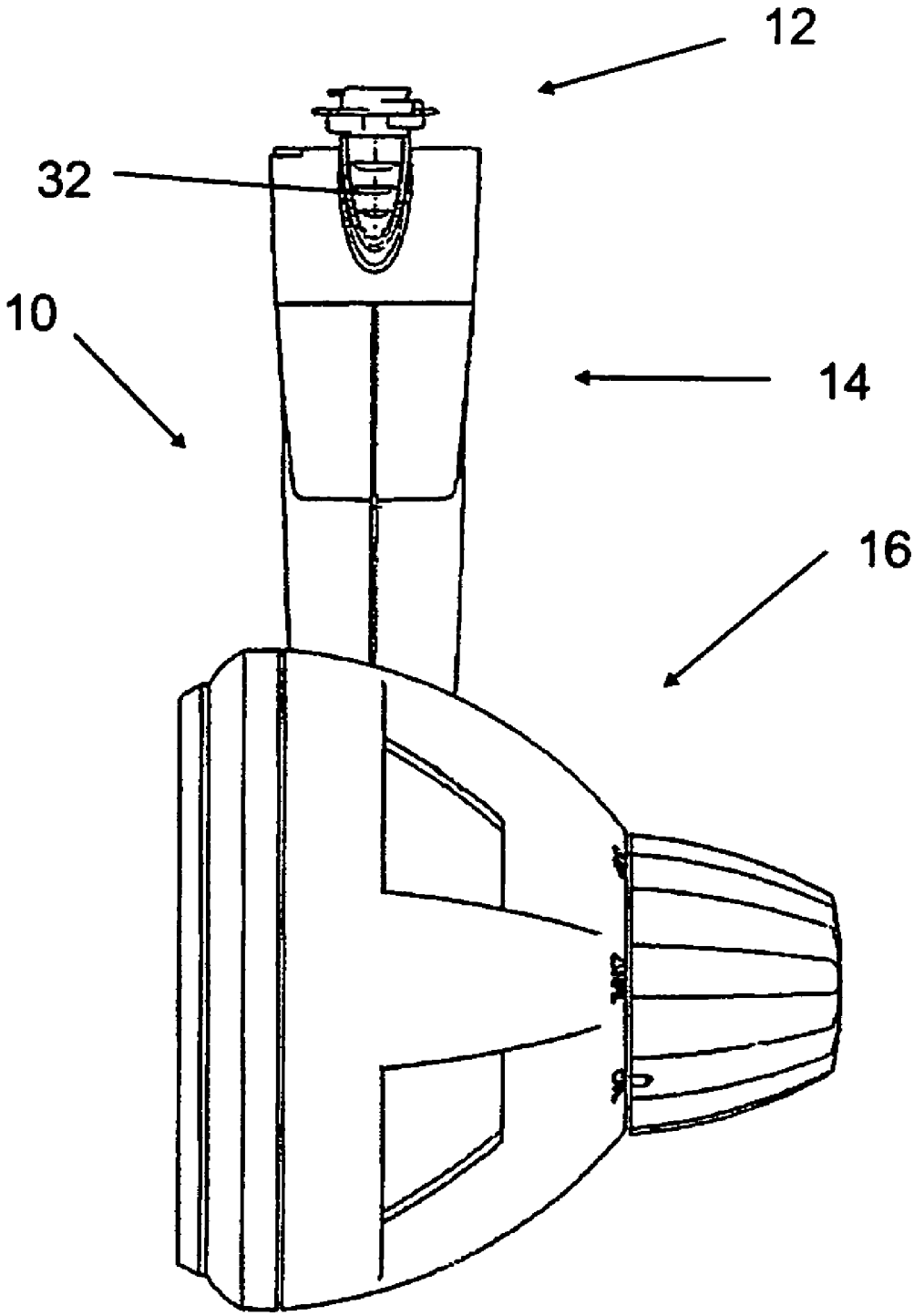
FIG. 2 is a right side view of the luminaire shown in FIG. 1.
Figure 3:
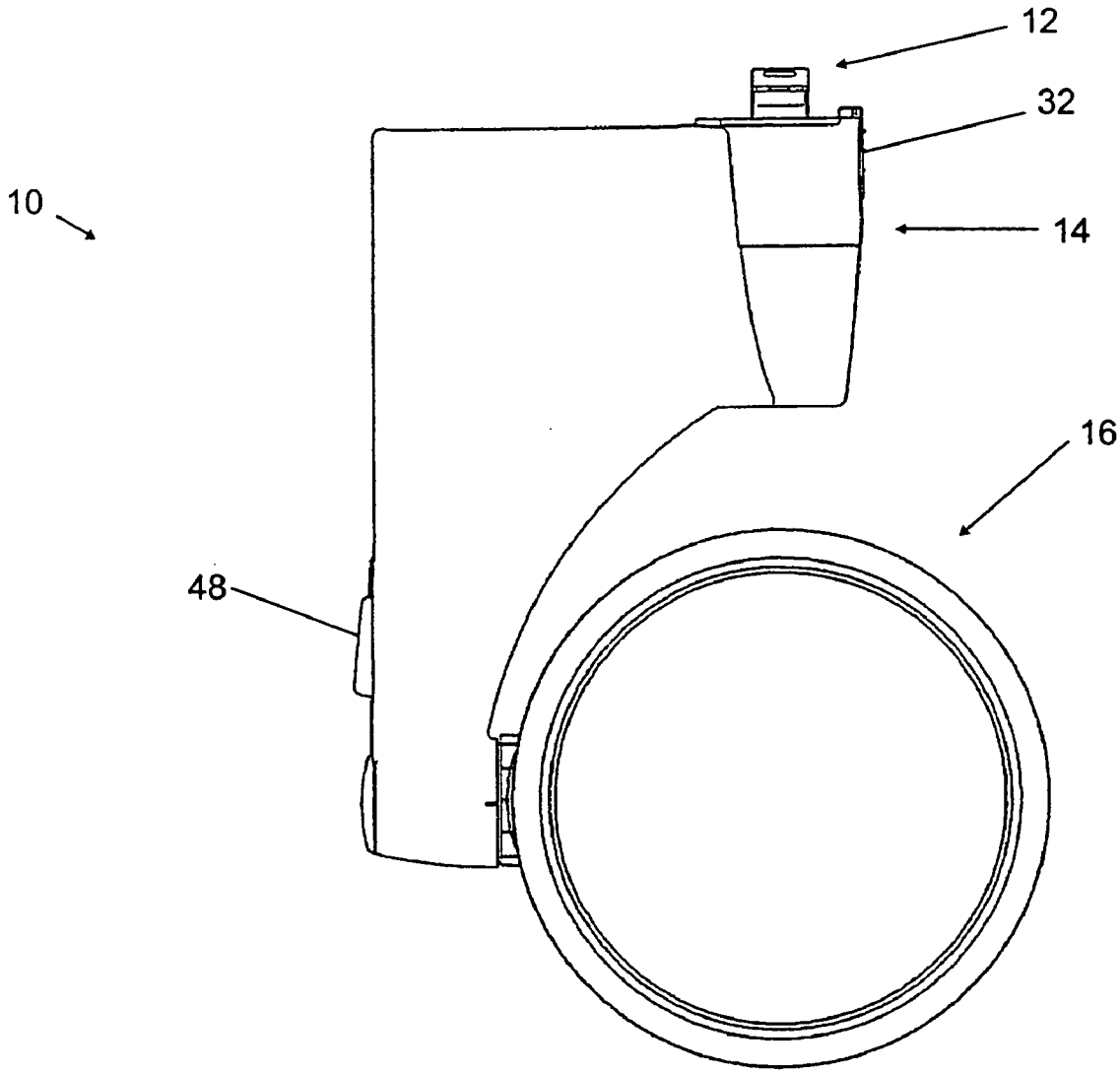
FIG. 3 is a front view of the luminaire shown in FIG. 1.
Figure 4:
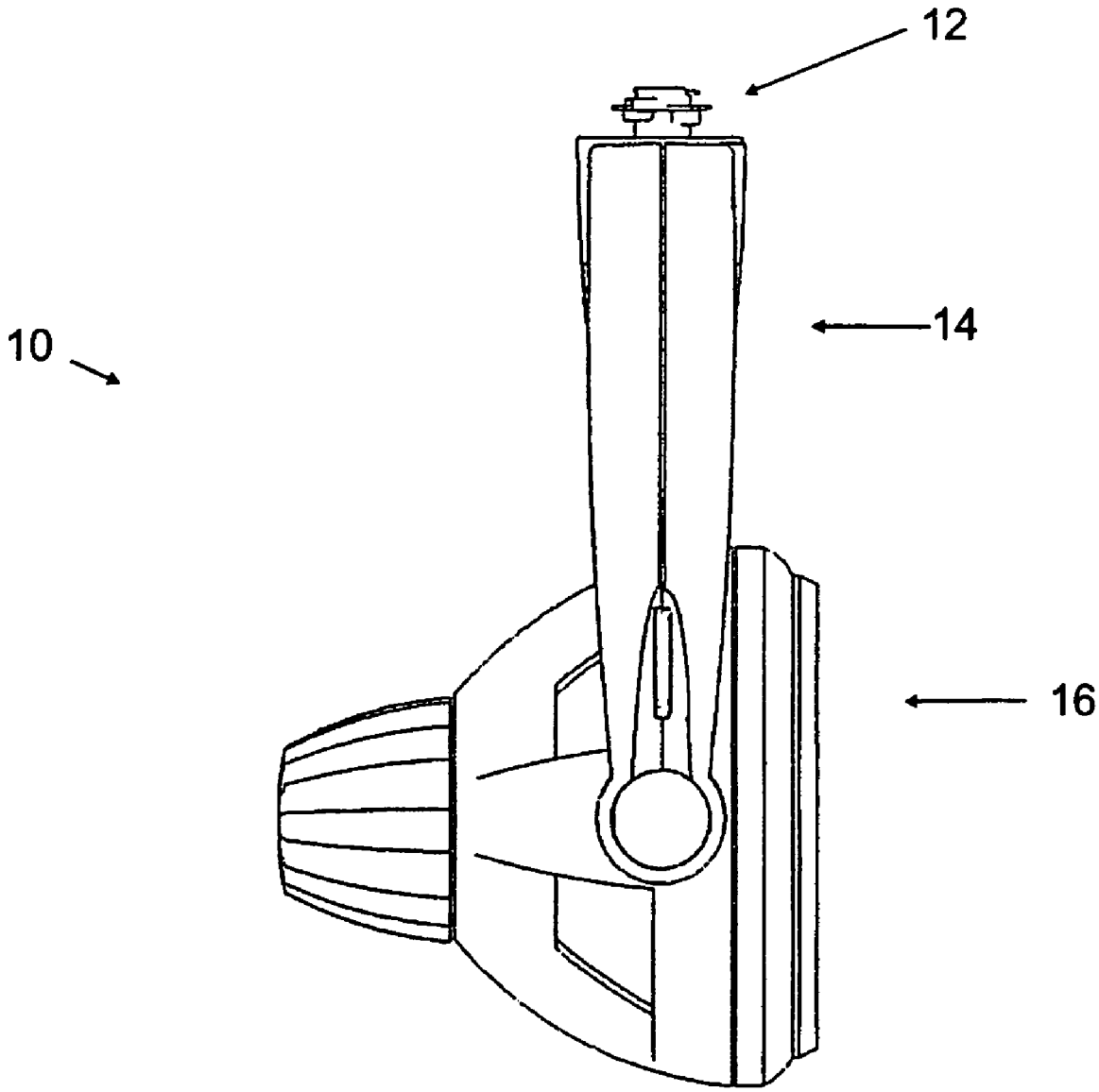
FIG. 4 is a left side view of the luminaire shown in FIG. 1.
Figure 5:
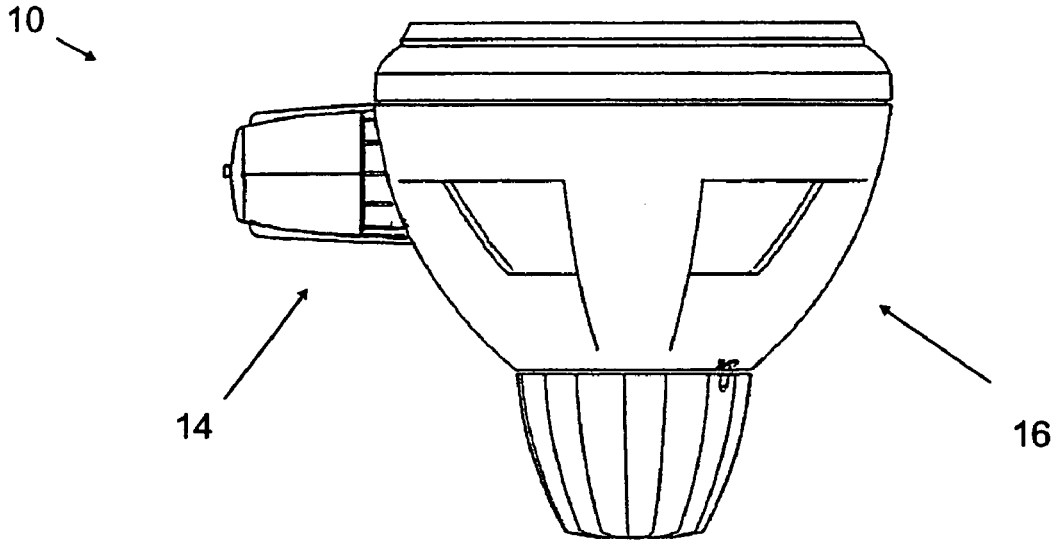
FIG. 5 is a bottom view of the luminaire shown in FIG. 1.
Figure 6:
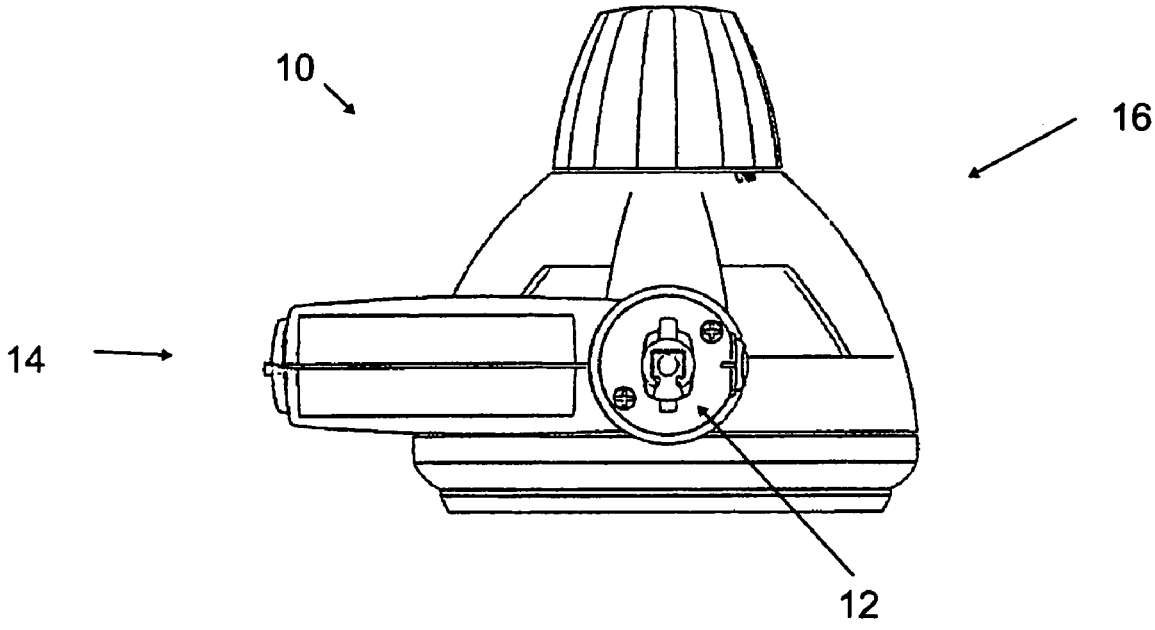
FIG. 6 is a top view of the luminaire shown in FIG. 1.
Figure 7:
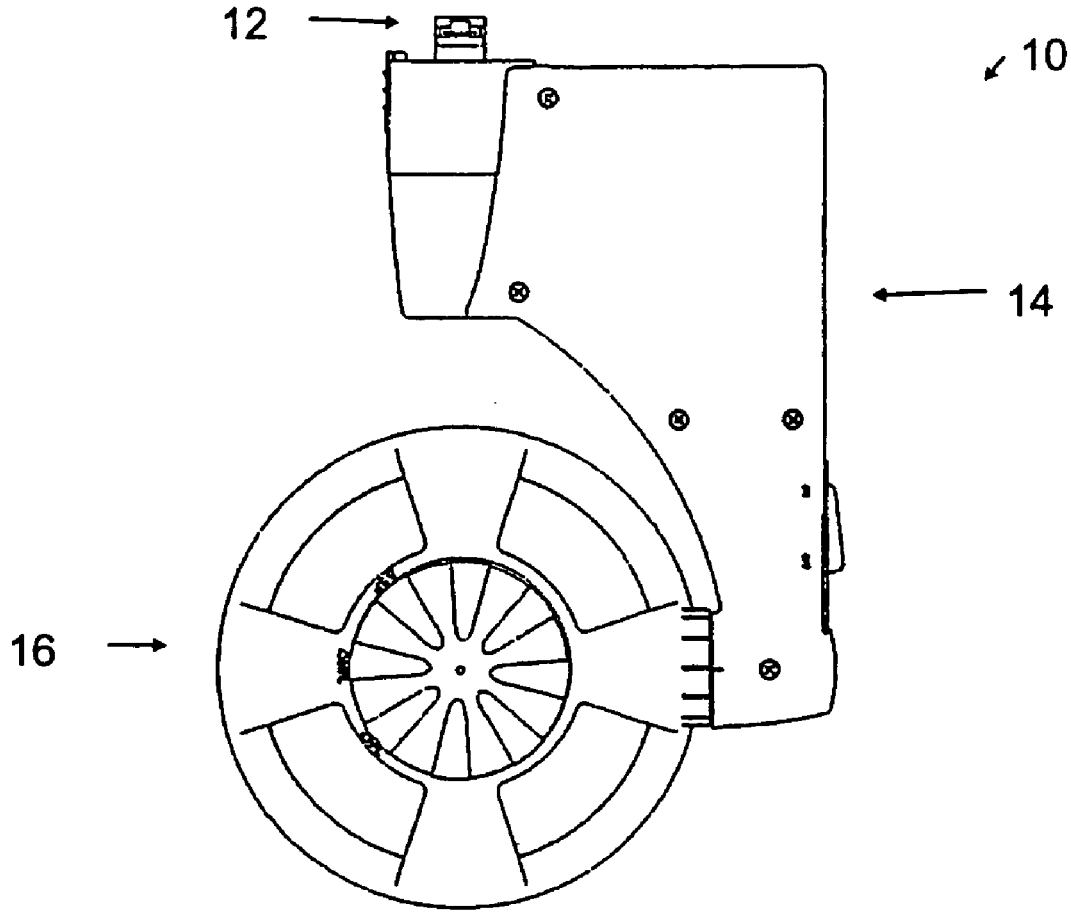
FIG. 7 is a rear view of the luminaire shown in FIG. 1.

FIG. 1 is an oblique view of one embodiment of a luminaire 10 having a focus assembly that is described in more detail below with respect to the other figures. The illustrated luminaire 10 includes a plug box assembly 12 extending from a ballast housing assembly 14 which rotatably supports a lamp housing assembly 16. FIGS. 2–7 illustrate various other side views of the luminaire 10 shown in FIG. 1. Although FIGS. 1–7 illustrate a luminaire for mounting in a track, such as the Halo™ Power-Trac™ system available from Cooper Lighting of Peachtree City, Ga., a variety of other tracks may be used. In addition, other mounting configurations may also be used including, but not limited to, ceiling mounts, wall mounts, pole mounts, and stand mounts.

Figure 8:
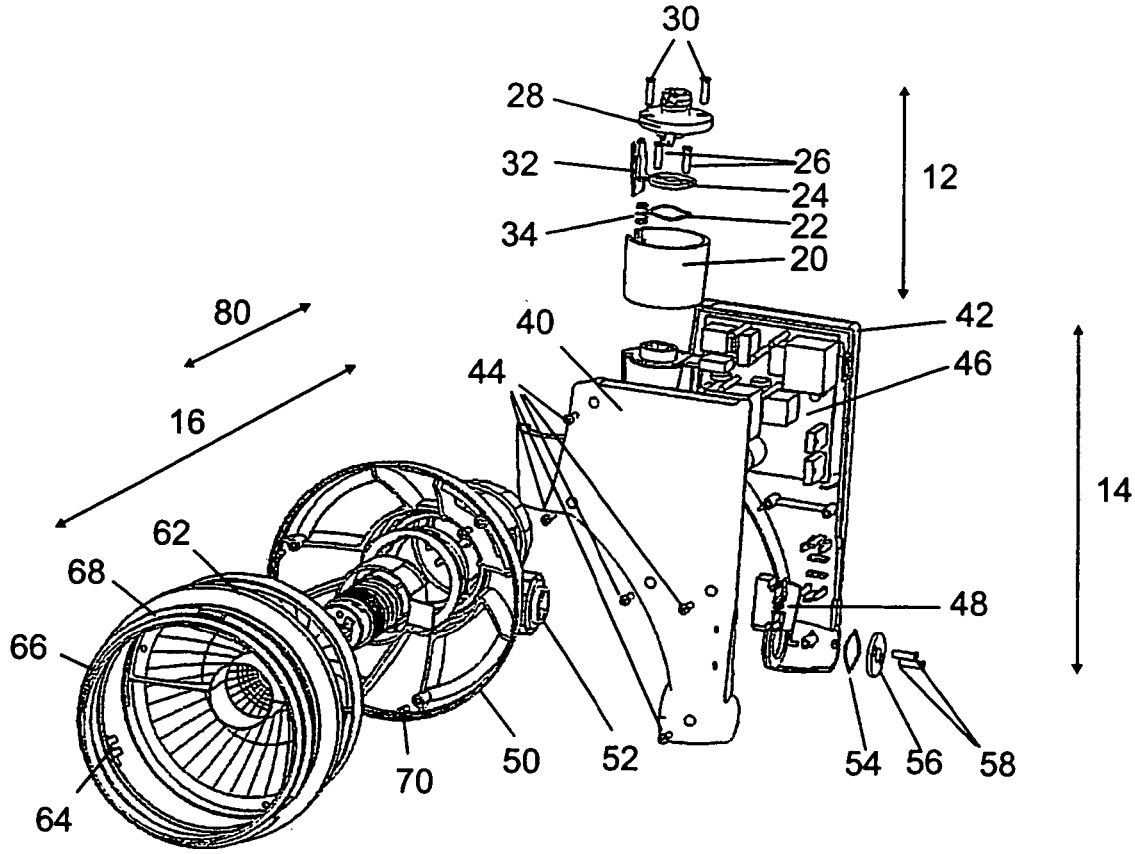
FIG. 8 is an exploded view of the luminaire shown in FIG. 1.

FIG. 8 is an exploded view of the luminaire 10 shown in FIGS. 1–7. In FIG. 8, the plug box assembly 12 includes a plug box 20 that receives a wave washer 22 for supporting a grounding disk 24 which are both secured by grounding disk screws 26. A track adapter plug 28 is also secured to the plug box 20 by additional grounding screws 30. In addition, a thumb latch 32 is arranged on one side of the adapter plug 28 so as to engage compression spring 34 inside the plug box 20.

The ballast housing assembly 14 includes a ballast housing front 40 which is secured to a ballast housing back 42 by ballast housing screws 44. However, the screws 44 may be replaced by a variety of other fasteners, including adhesives or snap fit components which may also be integrally formed with the ballast housing front 40 and/or ballast housing back 42. A ballast 46 is supported inside the ballast housing 40, 42 for powering lamps, such as a ceramic metal halide lamps, which require ballasted power. However, a variety of other lamps and/or power circuitry may also be provided. An optional switch 48 may also be arranged in the ballast housing 40, 42 for controlling external power to the ballast 46.

As discussed in more detail below with regard to FIG. 16, the ballast housing 14 is rotatably connected to the lamp housing assembly 16. In particular, the lamp housing assembly 16 includes a lamp housing basket 50 having an ear 52 which supports a washer 54 and receives a ground disk 56 which is secured by ground disk screws 58. Although the illustrated basket 50 is rotatable about only one axis, other configurations may also be provided where the basket 50 is rotatable about multiple axes and/or is fixed relative to the ballast housing 40, 42.

The basket 50 supports a variety of components including a reflector 60 and various other optical controls that may be secured to the basket 50 and/or the reflector 60 by trim screws 70. For example, in the embodiment illustrated in FIG. 8, a lens 62 is secured to the inner trim 68 by lens clips 64. In addition, an outer trim 66 and an inner trim 68 are fitted together and secured to the basket 50 by inserting tabs into slots in the basket 50 and rotating to lock. In FIG. 1, the lamp housing assembly 16 is provided with a glare shield 72 for minimizing glare from the lamp 74. A focus assembly 80 is arranged with various components on either side of the basket 50.

Figure 9:
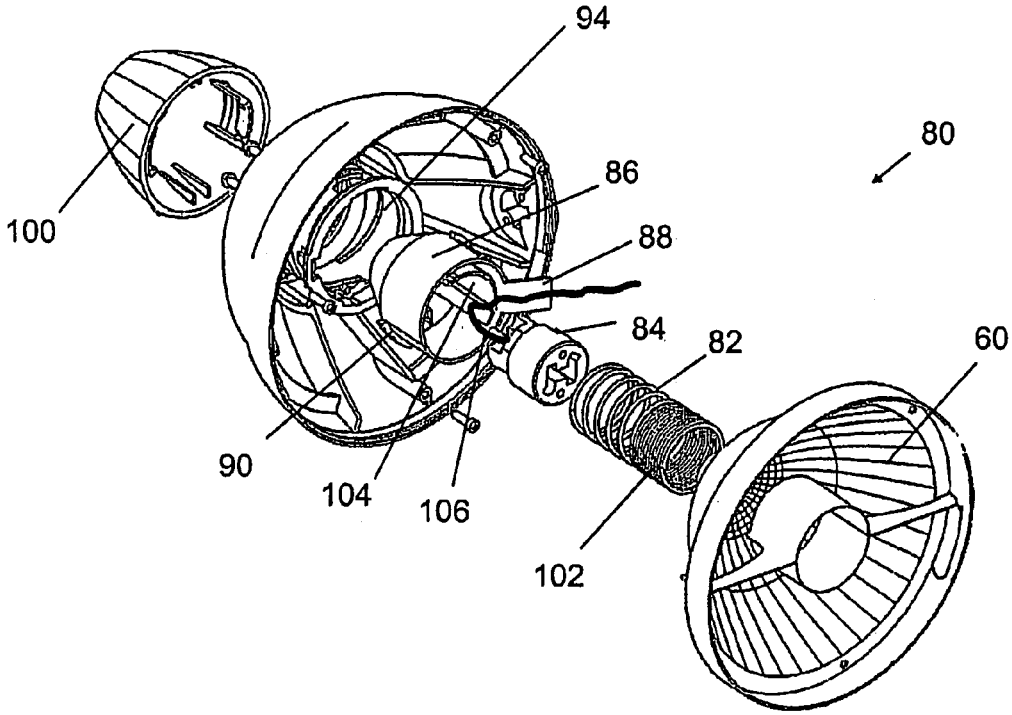
FIG. 9 is an exploded view of the focus assembly shown in FIG. 8.
Figure 10:
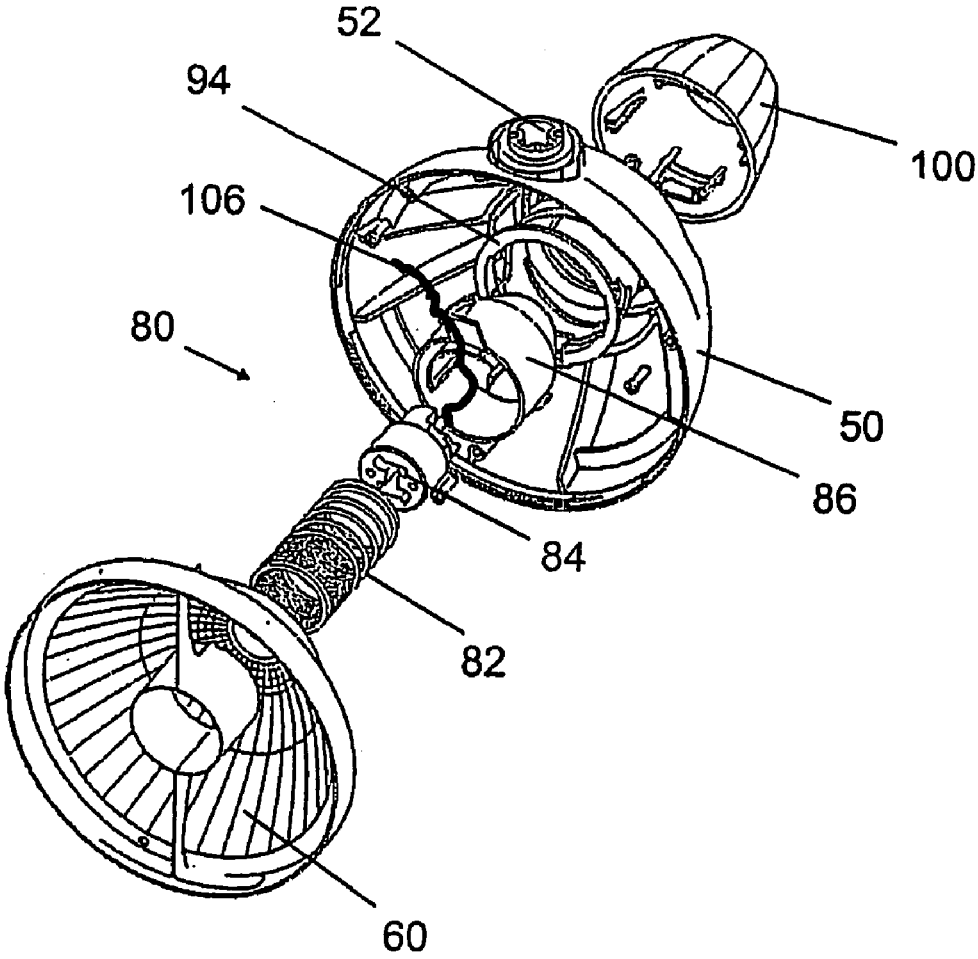
FIG. 10 is a rotated view of the focus assembly shown in FIG. 9.

As best illustrated in FIGS. 9 and 10, the focus assembly 80 includes a compression spring 82 which receives a neck portion extending from the back side of the reflector 60. Also arranged at least partially inside the compression spring 82 is a lamp socket 84 for receiving a lamp (74 in FIG. 1, not shown in FIGS. 8–10). The lamp socket 84 may also extend into the reflector 60. Although the illustrated lamp socket 84 is for use with a ceramic metal halide lamp, a variety of other lamps and corresponding lamp sockets may also be used.

The compression spring 82 and lamp socket 84 are arranged at least partially inside a mounting cup 86 having a wire guide tab 88 and a cam follower 90 best shown in FIG. 9. The wire guide tab 88 extends from the edge of the mounting cup 86 for shielding one or more wires 106 that extend from the lamp socket 84 and over the edge of the mounting cup 86. The cam follower 90 engages a cam 92 arranged in the side wall of a mounting cup receptacle 94.

Although the cam 92 is illustrated as a helical cam slot, for engaging a corresponding helical cam follower 90, a variety of other cams and cam followers, or other mechanisms, may also be used. For example, the cam follower 90 may take the form of a small nub or a rolling cam follower. The locations of the cam 92 and cam follower 90 may also be reversed so that the cam is arranged on the mounting cup 86 and the cam follower is arranged on the mounting cup receptacle 94.

The mounting cup receptacle 94 extends through the rear surface of the basket 50 and is secured to the focus knob 100. In this configuration, a user may grasp the focus knob 100 and turn the mounting cup receptacle 94 so as to axially translate the mounting cup 86 and lamp socket 84 relative to the reflector 60 as discussed below with respect to FIG. 16. Consequently, a lamp (74 in FIG. 1) that is fitted to the lamp socket 84 will translate relative to the reflector 60 (and glare guard 72 in FIG. 1, not shown in FIGS. 8–10) so as to adjust the beam width and/or other characteristics of the light that emanates from the luminaire 10.

In the illustrated embodiment, the compression spring 82 has been provided with an optional closed pitched section 102 for blocking light that might otherwise escape from the back side of the reflector 60. The closed pitch section may also be partially open for allowing a limited amount of light to pass through the spring.

In addition, the mounting cup 86 has been provided with an optional wire guide wall 104 for anchoring one or more wires 106 that extend from the lamp socket 84 to the mounting cup 86. In this configuration, as the lamp socket 84 is slid into the mounting cup 86, the wire 106 is compressed against the wire guide wall 104. This sandwiching of the wire or wires 106, between the inside surface of the wire guide wall 104 and the outside surface of the lamp socket 84, helps to prevent relative rotation between the mounting cup 86 and the lamp socket 84 which might otherwise damage the connection between the lamp socket 84 and wire 106.

FIGS. 9 and 10 also illustrate the wire guide tab 88 extending radially from the edge of the mounting cup 86. As shown in FIGS. 9 and 10, the wire guide tab 88 may extend from the mounting cup 86 in a direction comprising one or more directional components, wherein a directional component of the one or more directional components is directed generally radially outward from the axis of translation of the mounting cup 86. The wire guide tab 88 helps to shield the wire 106 from any sharp edges at the opening of the mounting cup 86 and/or at the opening of the mounting cup receptacle 94. The wire or wires 106 may also be clipped, or otherwise secured, to the wire guide tab 88. For example, the wire guide tab 88 may be provided with L-shaped brackets at each edge for holding a wire or wires (not shown in FIG. 8) against the wire guide tab 88. Clips, adhesive, or other fasteners, may also be provided for securing the wires to the wire guide tab 88.

Figure 11:
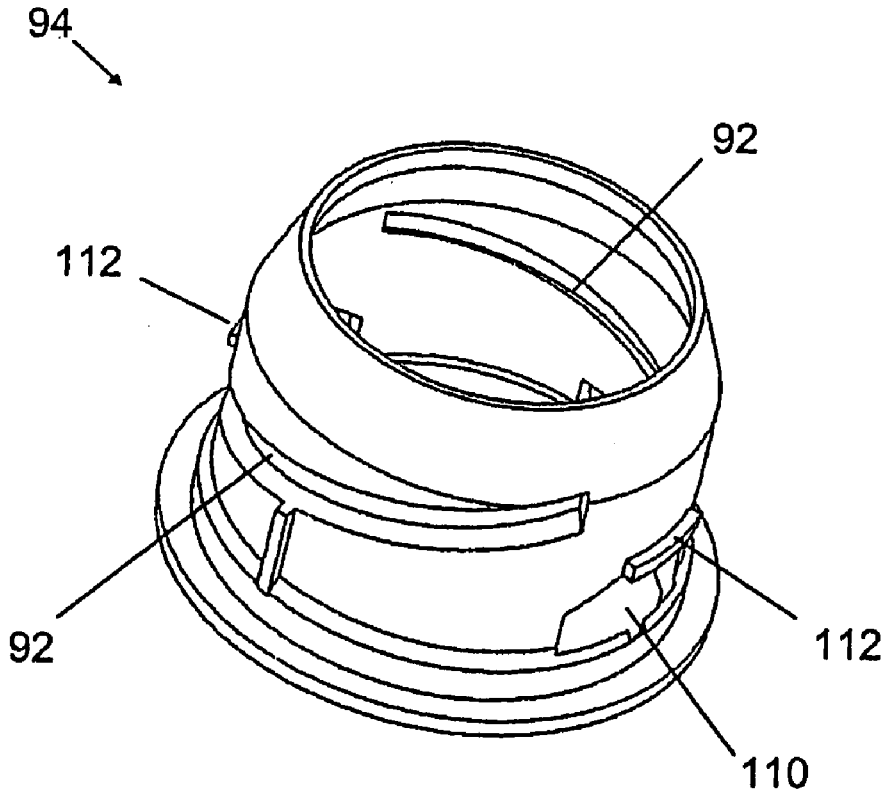
FIG. 11 is a bottom oblique view of the mounting cup receptacle shown in FIGS. 9 and 10.
Figure 12:
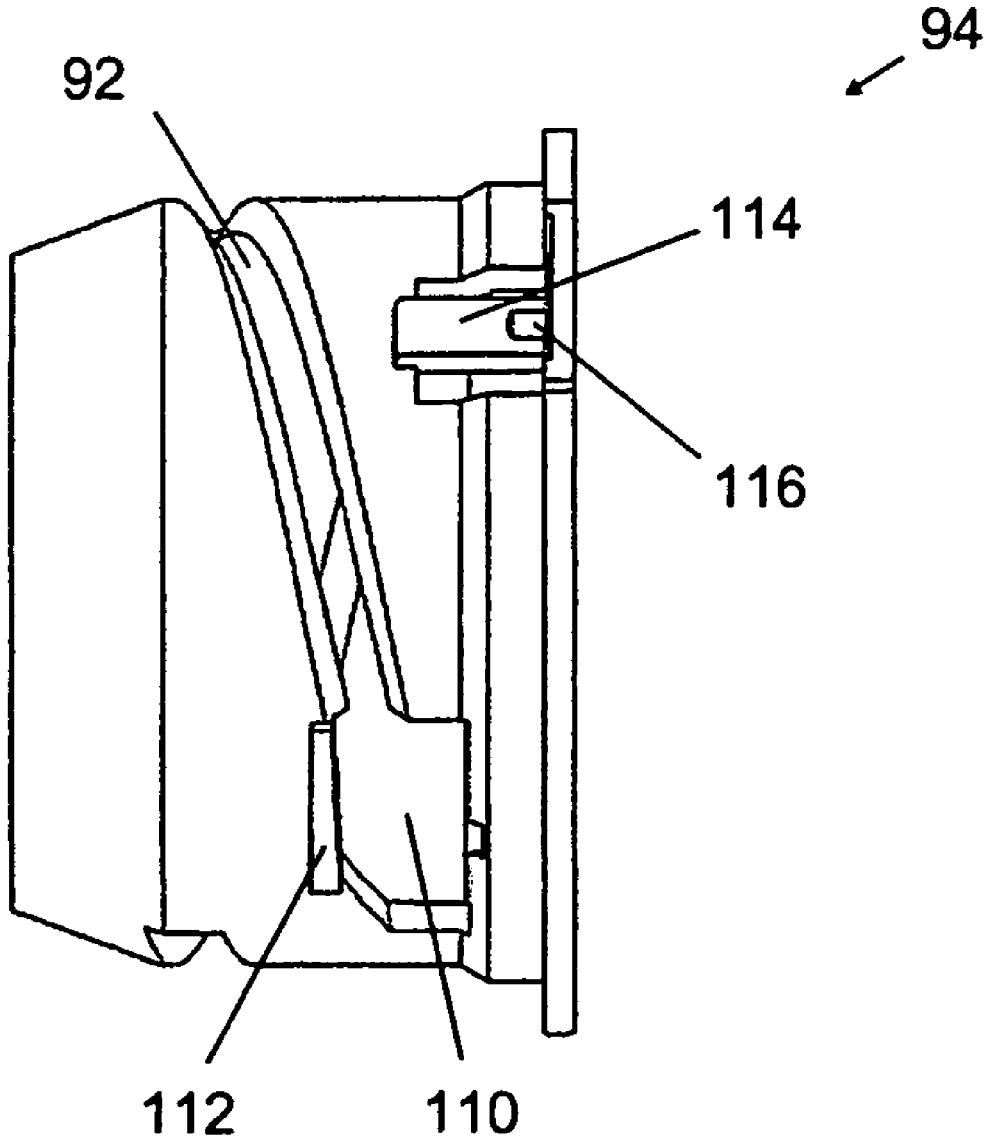
FIG. 12 is a rotated left side view of the mounting cup receptacle shown in FIG. 11.
Figure 13:
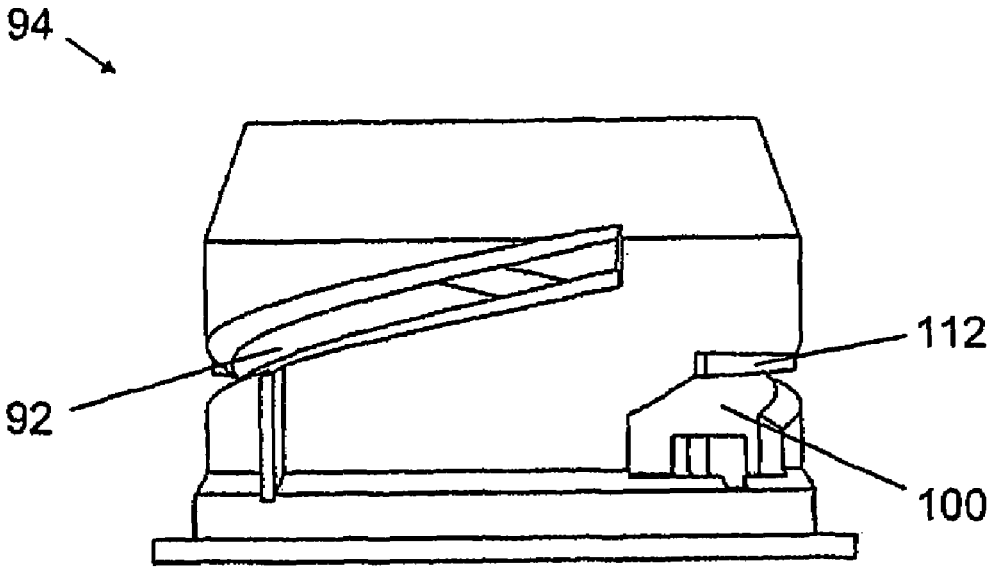
FIG. 13 is a rotated front view of the mounting cup receptacle shown in FIG. 11.

FIGS. 11–13 illustrate various views of the mounting cup receptacle 94 shown in the FIGS. 9 and 10. In this embodiment, the mounting cup receptacle 94 is provided with two cams 92 which are each in the form of helical slots. However, other cam designs may also be used, including stepwise, non-linear, and/or irregular cams. Edge and/or surface cams may also be used.

Each of the illustrated cam slots 92 is provided with a notch 110 at one end for releaseably locking the cam follower 90 on the mounting cup 86 in the slot. In particular, as the mounting cup receptacle 94 is rotated so that the mounting cup 86 is translated out of the mounting cup receptacle 94, the cam follower 90 will move into the notch 110 where it will be urged against the stop 112 by the compression spring 82 and releaseably locked in place. Once the cam follower 90 is in the notch 110, turning the knob 100 in the opposite direction will move the cam follower 90 back into the helical slot.

Figure 14:
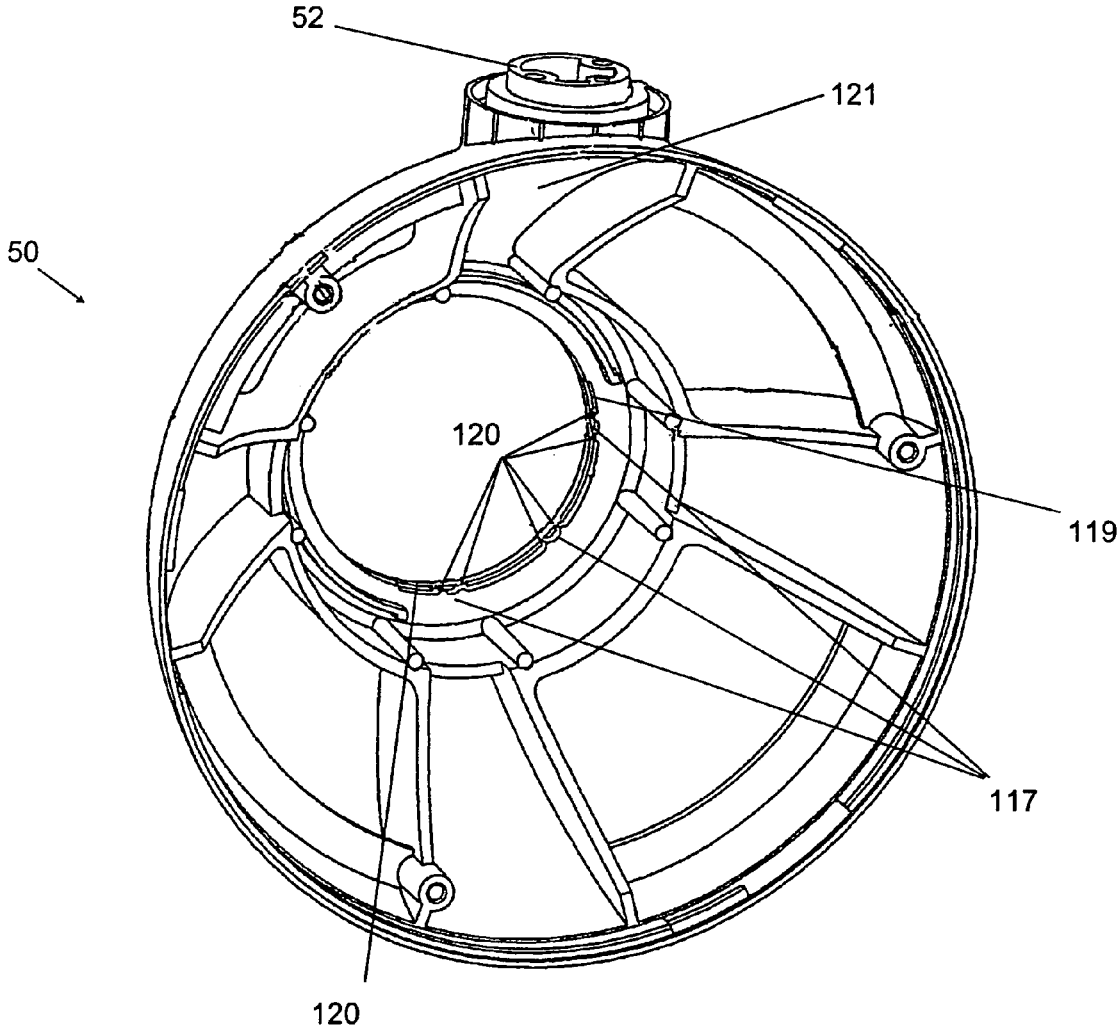
FIG. 14 is an oblique view of the basket shown in FIGS. 9 and 10.

The mounting cup receptacle 94 is further provided with an optional flexible tab 114 with a protuberance 116 for interfacing or engaging with positioning recesses 117 formed in the edge of the rear opening in the basket 50 as best shown in FIG. 14. For example, as illustrated in FIG. 14, an arc or shoulder recess 119 may be formed in at least part of the internal edge of the rear opening of the basket 50 where the positioning recesses 117 are formed between raised portions 120 that are left in the shoulder recess 119.

The depth of the shoulder recess 119 is preferably less than the length of the protuberance 116 so that the protuberance can slide around the shoulder recess until it reaches one of the raised portions 120. The protuberance 116 is then pushed back into the mounting cup receptacle 94 as it moves over the raised portion 120 and then snaps into the positioning recess 117. The three positioning recesses 117 illustrated in FIG. 14 therefore provide three rotational stops for the mounting cup receptacle 94 and, in turn, three axial stops for the axial position of the lamp relative to the reflector, and three beam widths for light emanating from the luminaire 10.

In addition, FIG. 14 also illustrates the slot 121 arranged near the ear 52 for receiving the wire guide tab 88 and position the wire 106 so that it extends through a hole (not shown in FIG. 14, see FIG. 9) and into the ear 52. The slot 121 prevents the mounting cup 86 from rotating with the mounting cup receptacle 94 while still allowing the mounting cup to move axially inside the mounting cup receptacle and the basket 50.

Figure 15:
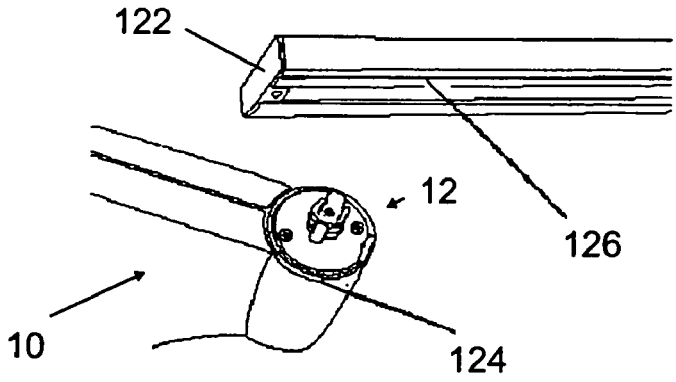
FIG. 15 is partial component diagram for a track lighting system.
Figure 16:
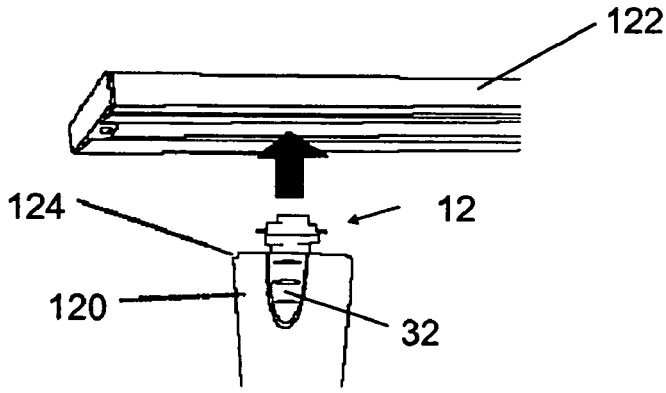
FIG. 16 is an assembly diagram for the track lighting system shown in FIG. 15.
Figure 17:
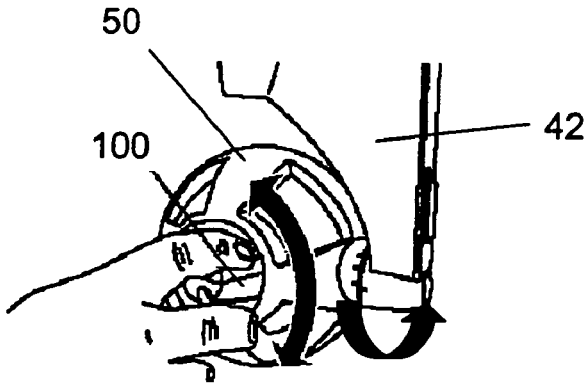
FIG. 17 is an operational diagram for the focus assembly of the luminaire shown in FIG. 1.

FIGS. 15–17 are diagrams illustrating various components, assembly and operation of certain aspects of the luminaire 10. In particular, FIG. 15 illustrates the luminaire 10 arranged under a track 22 while FIG. 16 illustrates the plug box assembly 12 of the luminaire being connected to a track 122. In this particular example, the plug box 20 is provided with a groove 124 for receiving a fixture polarity ridge 126 on the track 122 when the luminaire 10 is properly engaged with the track. However, the plug box assembly 12 and/or plug box 20 may be easily adapted to connect with a variety of other types of fixture brackets including other types of tracks, and vice versa.

During insertion, the thumb latch 32 is pushed downward against compression spring 34 (see FIG. 8) so that the plug box assembly 12 may be rotated relative to the track 122. Once the electrical contacts in the plug box assembly 12 are arranged substantially perpendicular to the longitudinal axis of the track 122, the thumb latch 32 is released and urged into the opening of the track so as to prevent further rotation of the plug box assembly 12.

Turning now to FIG. 17, once the luminaire 10 is secured to the track 122, or other mounting bracket, a user may turn the focus knob 100 in order to adjust the beam spread and/or other characteristics of the light emanating from the luminaire. A user may also aim the beam by rotating the basket 50 about the horizontal axis of the ballast housing back 42.

It should be emphasized that the various embodiments of the technology described above are merely examples of various implementations that have been used here in order to set forth an understanding of some of the benefits that it provides. Many variations and modifications may be made to these embodiments without departing from the scope of the invention defined by the following claims.

What is claimed is:

1. A focus assembly for a luminaire, comprising:

a socket, having one or more wires extending therefrom, for receiving a lamp;

a mounting cup for securing the socket to the luminaire;

a socket focusing mechanism for axially translating the mounting cup relative to a stationary reflector; and a wire guide tab, extending from a top of the mounting cup in a direction comprising one or more directional components, wherein a directional component of the one or more directional components is directed generally radially outward from the axis of translation of the mounting cup;

wherein at least a portion of each of the one or more wires is positioned relative to the wire guide tab so that the one or more wires are shielded from the socket focusing mechanism during the axial translation of the mounting cup.

2. The focus assembly of claim 1, further comprising a wire guide wall, arranged at least partially in the mounting cup, for anchoring the one or more wires to the mounting cup.

3. The focus assembly of claim 2, wherein the focusing mechanism further comprises:

a mounting cup receptacle;

a cam arranged on one of the mounting cup and the mounting cup receptacle; and a cam follower, arranged on the other of the mounting cup and the mounting cup receptacle, for engaging the cam.

4. The focus assembly of claim 3, wherein the cam comprises a helical slot arranged in a side wall of said one of the mounting cup and the mounting cup receptacle.

5. The focus assembly of claim 4, wherein the cam follower comprises a helical protuberance extending from a side wall of the other of the mounting cup and the mounting cup receptacle.

6. The focus assembly of claim 1, wherein the focusing mechanism further comprises:

a mounting cup receptacle;

a cam arranged on one of the mounting cup and the mounting cup receptacle; and a cam follower, arranged on the other of the mounting cup and the mounting cup receptacle, for engaging the cam.

7. The focus assembly of claim 6, wherein the cam comprises a helical slot arranged in a side wall of said one of the mounting cup and the mounting cup receptacle.

8. The focus assembly of claim 7, wherein the cam follower comprises a helical protuberance extending from a side wall of the other of the mounting cup and the mounting cup receptacle.

9. The focus assembly of claim 7, wherein the helical slot further comprises at least one notch for releaseably locking the cam follower in the slot.

10. The focus assembly of claim 9, further comprising a spring for urging the cam follower into the notch.

11. The focus assembly of claim 1 wherein another directional component of the one or more directional components is directed axially away from the socket focusing mechanism.

12. The focus assembly of claim 1 further comprising a wire guide wall arranged at least partially in the mounting cup so that the one or more wires are sandwiched between an inside surface of the wire guide wall and an outside surface of the socket.

13. The focus assembly of claim 12 wherein the sandwiching of the one or more wires between the inside surface of the wire guide wall and the outside surface of the socket generally resists relative rotation between the mounting cup and the socket.

14. A focus assembly for a luminaire, comprising:

a socket, having one or more wires extending therefrom, for receiving a lamp;

a mounting cup for securing the socket;

a focusing mechanism for axially translating the mounting cup relative to a stationary reflector; and a wire guide tab, extending from a top of the mounting cup in a direction comprising one or more directional components, wherein a directional component of the one or more directional components is directed generally radially outward from the axis of translation of the mounting cup;

a wire guide wall, arranged at least partially in the mounting cup, for anchoring the one or more wires to the mounting cup;

wherein the one or more wires are sandwiched between an inside surface of the wire guide wall and an outside surface of the socket.

15. The focus assembly of claim 14 wherein the sandwiching of the one or more wires between the inside surface of the wire guide wall and the outside surface of the socket generally resists relative rotation between the mounting cup and the socket.

16. The focus assembly of claim 15 wherein at least a portion of each of the one or more wires is positioned relative to the wire guide tab so that the one or more wires are shielded from the focusing mechanism during the axial translation of the mounting cup.

17. The focus assembly of claim 16 wherein another directional component of the one or more directional components is directed axially away from the focusing mechanism.

18. A focus assembly for a luminaire comprising a reflector, the focus assembly comprising:

means for receiving a lamp, the means for receiving having one or more wires extending therefrom;

means for securing the means for receiving to the luminaire;

means for axially translating the means for securing relative to the reflector;

means for anchoring the one or more wires to the means for securing;

means for generally resisting relative rotation between the means for securing and the means for receiving; and means, extending from the means for securing in a direction comprising one or more directional components, for shielding the one or more wires from the means for axially translating during translation of the means for securing;

wherein a directional component of the one or more directional components is directed generally radially outward from the axis of translation of the means for securing; and wherein another directional component of the one or more directional components is directed axially away from the means for axially translating.

19. A focus assembly for a luminaire, comprising:

means for receiving a lamp, the lamp receiving means having a wire extending therefrom;

means for securing the lamp receiving means to the luminaire;

means for translating the securing means axially relative to a stationary reflector, the translating means comprising:

a mounting cup receptacle;

a cam arranged on the securing means; and means for engaging the cam arranged on the mounting cup receptacle; and means for shielding the wire from the translating means during translation of the securing means, wherein the wire shielding means extends from the securing means in a direction having at least one directional component that is generally radially outward from the axis of translation of the securing means.

20. The focus assembly of claim 19 wherein the cam comprises a helical slot arranged in a side wall of the securing means.

21. The focus assembly of claim 20 wherein the cam engaging means comprises a helical protuberance extending from a side wall of the mounting cup receptacle.

22. The focus assembly of claim 20 wherein the helical slot comprises means for locking the cam engaging means releaseably in the slot.

23. The focus assembly of claim 22 further comprising means for urging the cam engaging means into the locking means.

24. The focus assembly of claim 19 further comprising means for anchoring the wire to the securing means, wherein the anchoring means is arranged at least partially in the securing means.

25. A focus assembly for a luminaire, comprising:

means for receiving a lamp, the lamp receiving means having a wire extending therefrom;

means for securing the lamp receiving means to the luminaire;

means for translating the securing means axially relative to a stationary reflector, the translating means comprising:

a mounting cup receptacle;

a cam arranged on the mounting cup receptacle; and means for engaging the cam arranged on the securing means; and means for shielding the wire from the translating means during translation of the securing means, wherein the wire shielding means extends from the securing means in a direction having at least one directional component that is generally radially outward from the axis of translation of the securing means.

26. The focus assembly of claim 25 wherein the cam comprises a helical slot arranged in a side wall of the mounting cup receptacle.

27. The focus assembly of claim 26 wherein the cam engaging means comprises a helical protuberance extending from a side wall of the securing means.

28. The focus assembly of claim 25 wherein the helical slot comprises means for locking the cam engaging means releaseably in the slot.

29. The focus assembly of claim 28 further comprising means for urging the cam engaging means into the locking means.

30. The focus assembly of claim 25 further comprising means for anchoring the wire to the securing means, wherein the anchoring means is arranged at least partially in the securing means.

31. A focus assembly for a luminaire, comprising:

a socket, having one or more wires extending therefrom, for receiving a lamp;

a mounting cup for securing the socket to the luminaire;

a socket focusing mechanism for axially translating the mounting cup relative to a stationary reflector; and a wire guide tab, extending from the mounting cup in a direction comprising one or more directional components, wherein a directional component of the one or more directional components is directed generally radially outward from the axis of translation of the mounting cup;

wherein at least a portion of each of the one or more wires is positioned relative to the wire guide tab so that the one or more wires are shielded from the socket focusing mechanism during the axial translation of the mounting cup;

wherein another directional component of the one or more directional components is directed axially away from the socket focusing mechanism; and wherein the focus assembly further comprises:

a wire guide wall arranged at least partially in the mounting cup so that the one or more wires are sandwiched between an inside surface of the wire guide wall and an outside surface of the socket;

wherein the sandwiching of the one or more wires between the inside surface of the wire guide wall and the outside surface of the socket generally resists relative rotation between the mounting cup and the socket.

32. A method of focusing a luminaire comprising a reflector, the method comprising:

providing a luminaire comprising:

a mounting cup;

a socket arranged at least partially inside the mounting cup such that the mounting cup and socket are axially translatable relative to the reflector but not rotatable relative to each other;

a wire extending from the socket and anchored to the mounting cup;

a wire guide tab configured to shield the wire from contact during axial translation of the mounting cup and socket relative to the reflector; and a lamp installed in the socket; and axially translating the mounting cup and socket relative to the reflector by rotating the mounting cup and socket relative to the reflector.

* * * * *